US008083429B2

(12) United States Patent
Grassia

(10) Patent No.: US 8,083,429 B2
(45) Date of Patent: Dec. 27, 2011

(54) MODULAR LOCKING BINDER SYSTEM

(75) Inventor: Lauren Grassia, Melville, NY (US)

(73) Assignee: Esselte Corporation, Melville, NY (US)

( * ) Notice: Subject to any disclaimer, the term of this patent is extended or adjusted under 35 U.S.C. 154(b) by 392 days.

(21) Appl. No.: 12/410,783

(22) Filed: Mar. 25, 2009

(65) Prior Publication Data

US 2010/0247227 A1 Sep. 30, 2010

(51) Int. Cl.

| | |
|---|---|
| ***B42F 3/00*** | (2006.01) |
| ***B42F 13/40*** | (2006.01) |
| ***B42F 13/12*** | (2006.01) |
| ***B42F 13/36*** | (2006.01) |
| ***B42F 13/00*** | (2006.01) |
| ***B42F 5/00*** | (2006.01) |
| ***B42D 1/00*** | (2006.01) |
| ***B42D 1/08*** | (2006.01) |
| ***B42D 17/00*** | (2006.01) |
| ***B42D 3/00*** | (2006.01) |
| ***B42D 7/00*** | (2006.01) |

(52) U.S. Cl. ..... 402/70; 402/60; 402/61; 402/62; 402/68; 402/79; 402/2; 281/21.1; 281/22; 281/43; 281/46; 281/47; 281/48; D19/32

(58) Field of Classification Search ..... 402/2, 17, 402/24, 58–61, 500, 501, 63, 68; 281/22, 281/28, 42, 43, 45; 40/374, 375; 211/40, 211/42, 45, 46; 206/308.2, 311, 387.15
See application file for complete search history.

(56) References Cited

U.S. PATENT DOCUMENTS

| | | | | | |
|---|---|---|---|---|---|
| 178,975 | A | * | 6/1876 | Stiles | 402/2 |
| 577,218 | A | | 2/1897 | Weis | |
| 823,168 | A | * | 6/1906 | Hafely | 281/22 |
| 1,187,420 | A | * | 6/1916 | Edwards | 281/46 |
| 1,402,332 | A | * | 1/1922 | Wiehl | 211/40 |
| 1,624,660 | A | * | 4/1927 | Mandel | 281/47 |
| 1,697,053 | A | * | 1/1929 | Daniels | 402/46 |
| 1,806,057 | A | * | 5/1931 | Heer | 281/23 |
| 2,127,619 | A | * | 8/1938 | Rosenthal | 281/17 |
| 2,232,713 | A | * | 2/1941 | Feldmann | 281/47 |
| 2,414,007 | A | * | 1/1947 | Ziegler | 281/27.3 |
| 2,552,704 | A | * | 5/1951 | Armstrong et al. | 402/500 |
| 3,353,844 | A | * | 11/1967 | Staats | 402/500 |
| 3,798,810 | A | * | 3/1974 | Brisson et al. | 40/375 |
| 3,971,572 | A | | 7/1976 | Fenkel | |
| 4,162,007 | A | * | 7/1979 | Bothun et al. | 206/311 |
| 4,305,510 | A | | 12/1981 | Eppy | |
| 4,328,898 | A | * | 5/1982 | Grassi | 211/41.17 |
| 4,426,007 | A | * | 1/1984 | Beleckis et al. | 211/40 |
| 4,445,710 | A | * | 5/1984 | Borel | 281/45 |

(Continued)

*Primary Examiner* — Dana Ross

*Assistant Examiner* — Kyle Grabowski

(74) *Attorney, Agent, or Firm* — Pillsbury Winthrop Shaw Pittman LLP

(57) ABSTRACT

A modular locking binder system is disclosed having a channel is coupled to the binder spine. The channel has an open end and a constricted region. A channel block is located at the open end of said channel and is configured to block and unlock the channel opening. The modular locking binder system is configured to removably hold a document module within the channel. The document module includes a module spine having a widened portion configured to operatively engage and be restrained by the constricted region of the channel. By either obstructing or un-obstructing the channel with the channel block, it is possible to removeably secure the document module within the channel when the widened ends of the document module are operatively engaged and restrained by the constricted portions of the channel.

26 Claims, 17 Drawing Sheets

U.S. PATENT DOCUMENTS

| | | | | | |
|---|---|---|---|---|---|
| 4,591,187 | A | * | 5/1986 | Jeanson et al. | 402/502 |
| 4,793,495 | A | * | 12/1988 | Preu | 40/375 |
| 4,820,075 | A | * | 4/1989 | Osono | 402/79 |
| 4,940,353 | A | * | 7/1990 | Osono et al. | 402/79 |
| 4,993,750 | A | * | 2/1991 | Hoffmeister et al. | 281/48 |
| 5,056,823 | A | * | 10/1991 | Stancato | 281/49 |
| 5,183,296 | A | | 2/1993 | Policht | |
| 5,433,480 | A | | 7/1995 | Gresham et al. | |
| 5,709,494 | A | | 1/1998 | Deutsch | |
| 5,725,251 | A | | 3/1998 | Heggeland | |
| 5,964,480 | A | | 10/1999 | Chen | |
| 6,206,426 | B1 | | 3/2001 | Azzato | |
| 6,994,377 | B2 | | 2/2006 | Büttner | |
| 7,793,791 | B1 | * | 9/2010 | Pouille | 211/46 |
| 7,802,938 | B2 | * | 9/2010 | Goodfellow et al. | 402/58 |
| 2007/0085331 | A1 | | 4/2007 | Mueller | |

* cited by examiner

MODULAR LOCKING BINDER SYSTEM

FIELD OF THE INVENTION

The present invention relates to the field of systems for organizing documents, and more particularly to a modular filing system for holding documents in a binder.

BACKGROUND OF THE INVENTION

Systems for organizing and holding documents are well-known and exist in many varieties. A common system for organizing documents is with a ring-type binder. These ring-type binders typically include a plurality of loose-leaf page retaining members positioned longitudinally between opposing ends of such binders. The page retaining members are configured to extend through corresponding apertures in the preferred loose-leaf elements thereby retaining the loose-leaf elements in the ring-type binder.

In some ring-type binders, the page retaining members include two separable members which, then adjoined, form a loop for retaining loose-leaf elements. These separable page retaining members are configured to permit the user to insert loose-leaf elements in the binder and to remove or replace loose-leaf elements retained therein.

In other binders, the page retaining members do not separate in a manner which enables the user to insert or replace loose-leaf elements. These binders may take the form of a conventional spiral or other notebooks wherein the loose leafs are fixed therein using a continuous wire member configured in a helix or other manner so as to define a plurality of loose-leaf page retaining members.

Binders come in many standard sizes with respect to both capacity and paper size. The most common type in the United States is a three ring system for letter size pages (8½×11 in), whereas most other countries use a two or four hole system for holding A4 sheets. The lever arch system is particularly useful for larger amounts of paper. Some personal organizers and memorandum books use a six or seven hole system.

Most binder covers are made of three pieces, in the fashion of a hardback book, but are produced in many styles. Materials vary widely. Some vinyl binders have a clear pocket on the outside for cover pages, and many have pockets in the inner cover for loose papers, business cards, compact discs, etc. There are also zipper binders, which zip the binder up and keep papers from falling out.

SUMMARY OF THE INVENTION

The present invention is directed toward a modular locking binder system. The modular locking binder system includes a binder that has a binder spine coupled to a pair of cover-flaps. A channel is coupled to the binder spine. The channel has an open end. The channel also has a constricted region. A channel block is located at the open end of said channel and is configured to move from an open position wherein the open end of said channel is unobstructed by said channel block, and a closed position where the open end of said channel is obstructed by said channel block. The modular locking binder system is configured to removably hold a document module within the channel. The document module includes a module spine having a widened portion configured to operatively engage and be restrained by the constricted region of the channel. By obstructing the channel with the channel block, the document modules is prevented from being removed from said binder when the widened portion of said document module is operatively engaged and restrained by the constricted portion of the channel. By repositioning the channel block so that it does not obstruct the channel, it is possible to remove, or insert a document module into the channel.

The present invention is also directed towards a modular document system that includes a plurality of document modules, wherein each document module has a spine with a widened portion. The system also includes a binder configured to removably hold each of the plurality of document modules. The binder has a binder spine and a pair of cover flaps attached to said binder spine. A frame is attached to said binder spine. The frame includes a plurality of channels having a narrow portions configured to engage and restrain the widened portion of each document module. The frame also includes a locking mechanism configured to restrain each document module within each channel, whereby unlocking the locking mechanism allows for the insertion or removal of a document module from a channel.

The present invention is also directed towards a binder that has a binder spine and a pair of covers attached to said binder spine. A frame is attached to the binder spine, wherein the frame includes a channel having an open end and a constricted portion. The frame also includes a latch configured to block and unblock the open end of said channel. The binder is provided to hold document modules, each of which include a module spine. A protrusion extends from the module spine and are configured to engage and be restrained by the constricted portion of the channel. Opening the latch to unblock the open end of the channel allows for the module spine to be inserted into and slid down the length of said channel and have the protrusion engage and be restrained by the constricted portion. Blocking the channel with the latch restrains the document module within the channel together with the constricted portion.

Other objects and features and advantages of the present invention will become apparent from the following detailed description, the accompanying drawings, and the appended claims.

BRIEF DESCRIPTION OF THE DRAWINGS

The novel features that are considered characteristic of the invention are set forth with particularity in the appended claims. The invention itself; however, both as to its structure and operation together with the additional objects and advantages thereof are best understood through the following description of the preferred embodiment of the present invention when read in conjunction with the accompanying drawings, wherein:

DETAILED DESCRIPTION

Figure 1:
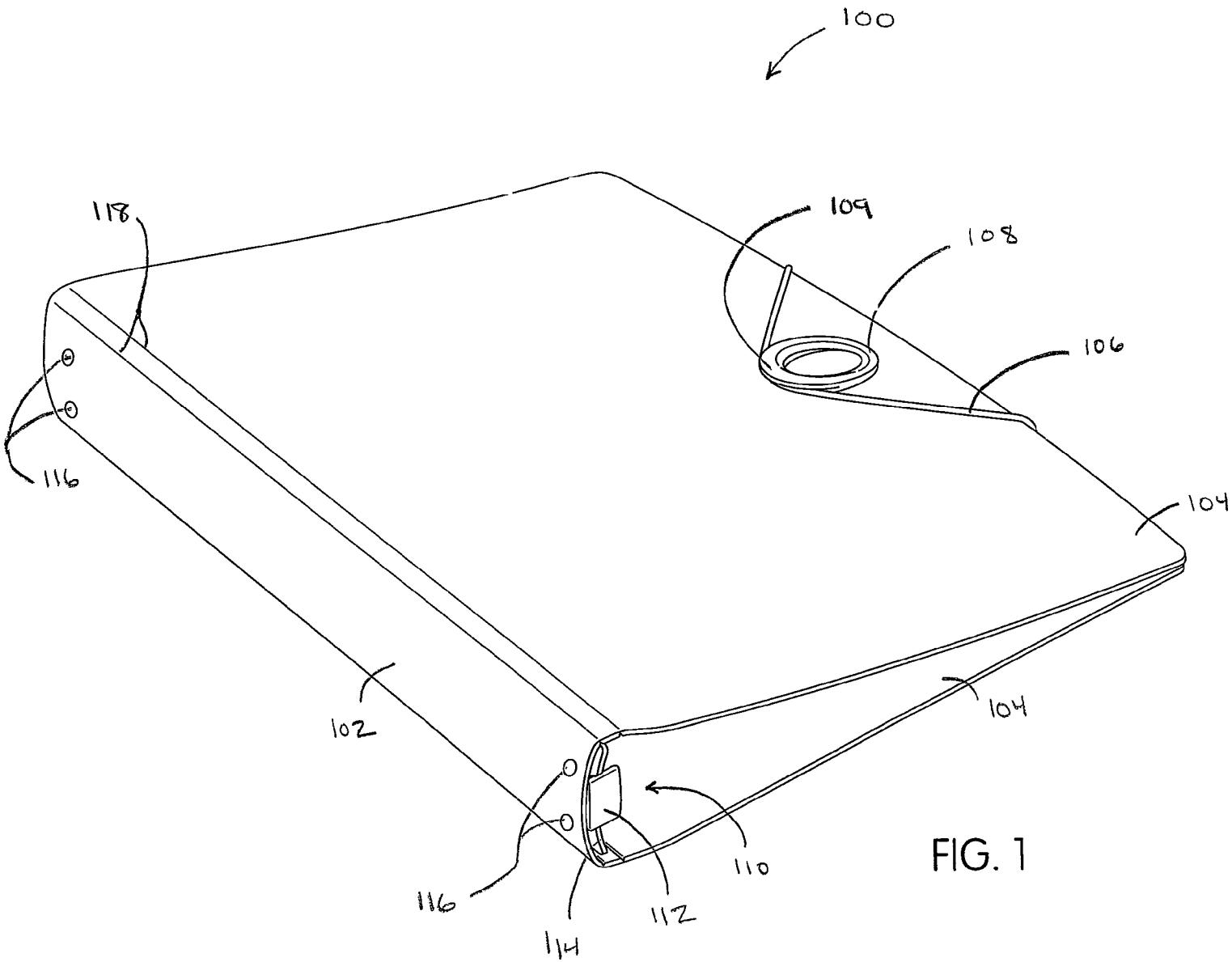
FIG. 1 illustrates a perspective view of a modular locking binder system in a closed position according to a preferred embodiment of the invention.

The novel features that are considered characteristic of the invention are set forth with particularity in the appended claims. The invention itself; however, both as to its structure and operation together with the additional objects and advantages thereof are best understood through the following description of the preferred embodiment of the present invention when read in conjunction with the accompanying drawings, wherein:

FIG. 1 illustrates a perspective view of a modular locking binder system 100 in a closed position according to a preferred embodiment of the invention. Modular locking binder system 100 includes a spine 102 that is attached to a pair of cover flaps 104. Modular locking binder system 100 is configured to contain a plurality of document modules illustrated in FIGS. 9-16. Spine 102 and cover flaps may be formed from a variety of thin rigid or flexible materials, such as for example, vinyl-covered cardboard, plastic, metal, or a lightweight composite material. Cover flaps 104 bend with respect to spine 102, thereby allowing modular locking binder system 100 to adopt open and closed configurations.

Flexible strap 106 is optionally provided to hold modular locking binder system 100 in a closed configuration. Flexible strap 106 is securely attached to one of the cover flaps 104 and is configured to engage strap retention protrusion 108, which is securely mounted to the other cover flap. Flexible strap 106 is flexible and stretchable enabling it to be stretched away from strap retention protrusion 108, thereby enabling flexible strap to be engaged and disengaged to being coupled with strap retention protrusion 108. Strap retention protrusion 108 is configured to include a lip 109 that holds flexible strap 106 in position when flexible strap 106 is engaged with strap retention protrusion 108.

Spine lock 110 is mounted to spine 102. Spine lock 110 is configured to engage and hold the document modules illustrated in FIGS. 9-16. Spine lock 110, illustrated in more detail in FIGS. 2-7, includes a latch 112 and frame 114. An actuator 112 in the form of a latch is used by a user to lock and unlock document modules from modular locking binder system 100. Latch 112 moves between locked and unlocked positions. Latch 112 is moveably attached to frame 114. Frame 114 is securely attached to spine 102 by fasteners 116.

Creases 118 are formed in modular locking binder system 100 where cover flaps 104 join with spine 102. In FIG. 1, modular locking binder system 100 is shown in a closed configuration where cover flaps 104 are joined together and held in a closed position by flexible strap 106.

Figure 2:
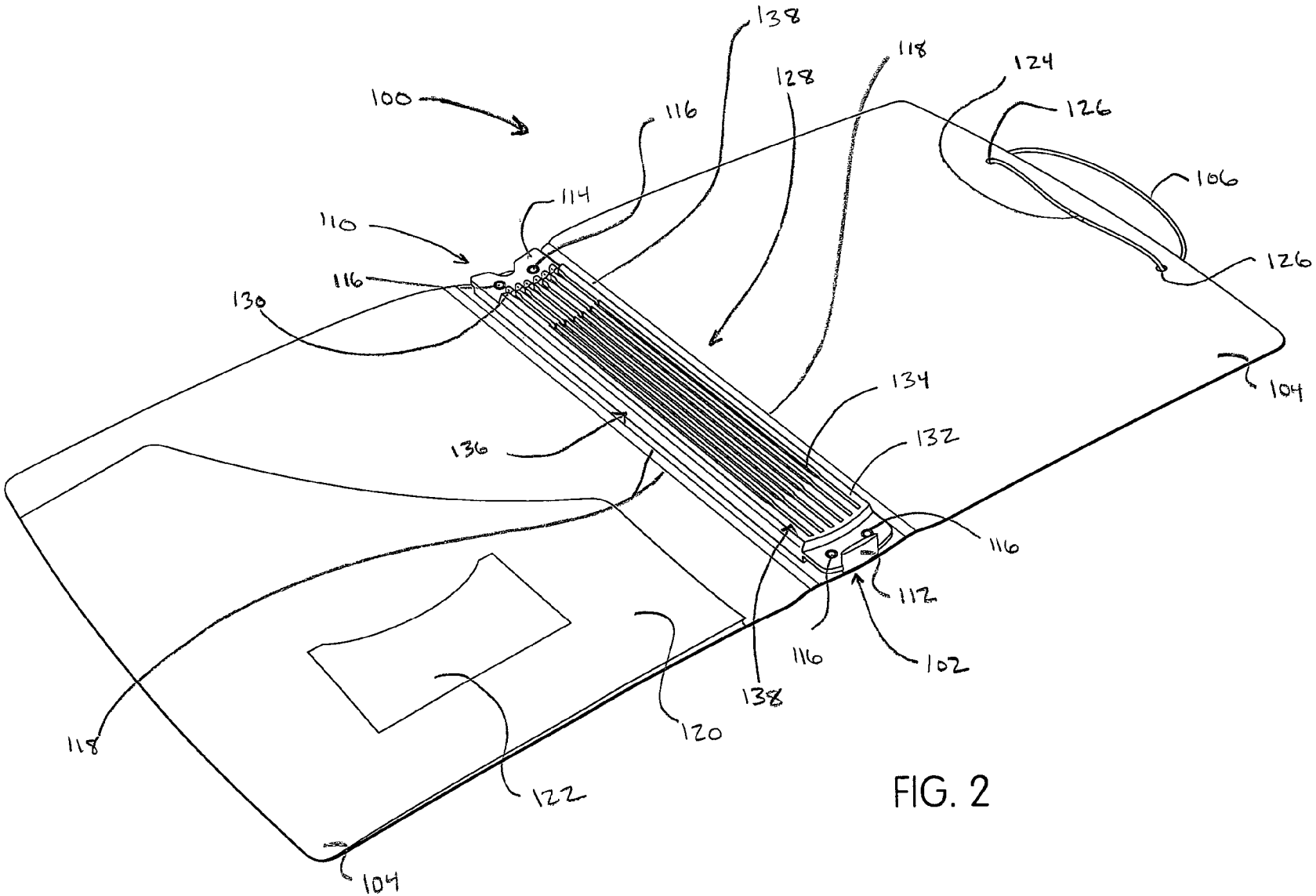
FIG. 2 illustrates a perspective view of a modular locking binder system in an open position according to a preferred embodiment of the invention.

FIG. 2 illustrates a perspective view of a modular locking binder system 100 in an open position according to a preferred embodiment of the invention. One cover flap 104 is provided with a large pocket 120 for restraining a variety of documents or other materials within modular locking binder system 100. A small pocket 122 is provided on large pocket 120. Small pocket 122 is configured to retain small documents such as business cards.

Flexible strap 106, in this exemplary embodiment, is formed of a strand of flexible cording that is joined together at the ends by a cord joint 124 that holds the two ends of flexible strap 106 together, thereby forming a loop. Flexible strap 106 extends through holds 126 formed in cover flap 104, thereby securing flexible strap 106 to cover flap 104. Alternatively, instead of joining the cord ends to form a loop, the cord ends may be affixed individually to the flap 104.

Fasteners 116 that secure frame 114 of spine lock 110 are visible on the interior of modular locking binder system 100. Frame 114 includes a plurality of channels 128 that are configured to engage the document modules shown in FIGS. 9-16. A plurality of channel blocks 130 are provided at the top end of channels 128. Note that a bottom end of channels 128 is closed, thereby terminating the channels 128. By terminating the channels 128, the bottom end prevents any document modules contained within channels 128 from sliding out of the bottom portion 132. Channels 128 include grooves 134 in which the document modules are restrained. A middle portion 136 of channels 128 is characterized by wide grooves 134. Note that before the channels 128 are terminated, channels 128 are also constricted in portions 138 at both the top and bottom portions of channels 128, thereby forming surfaces 132 at the top and bottom portions of channels 128 and also forming narrower grooves 134.

Figure 3:
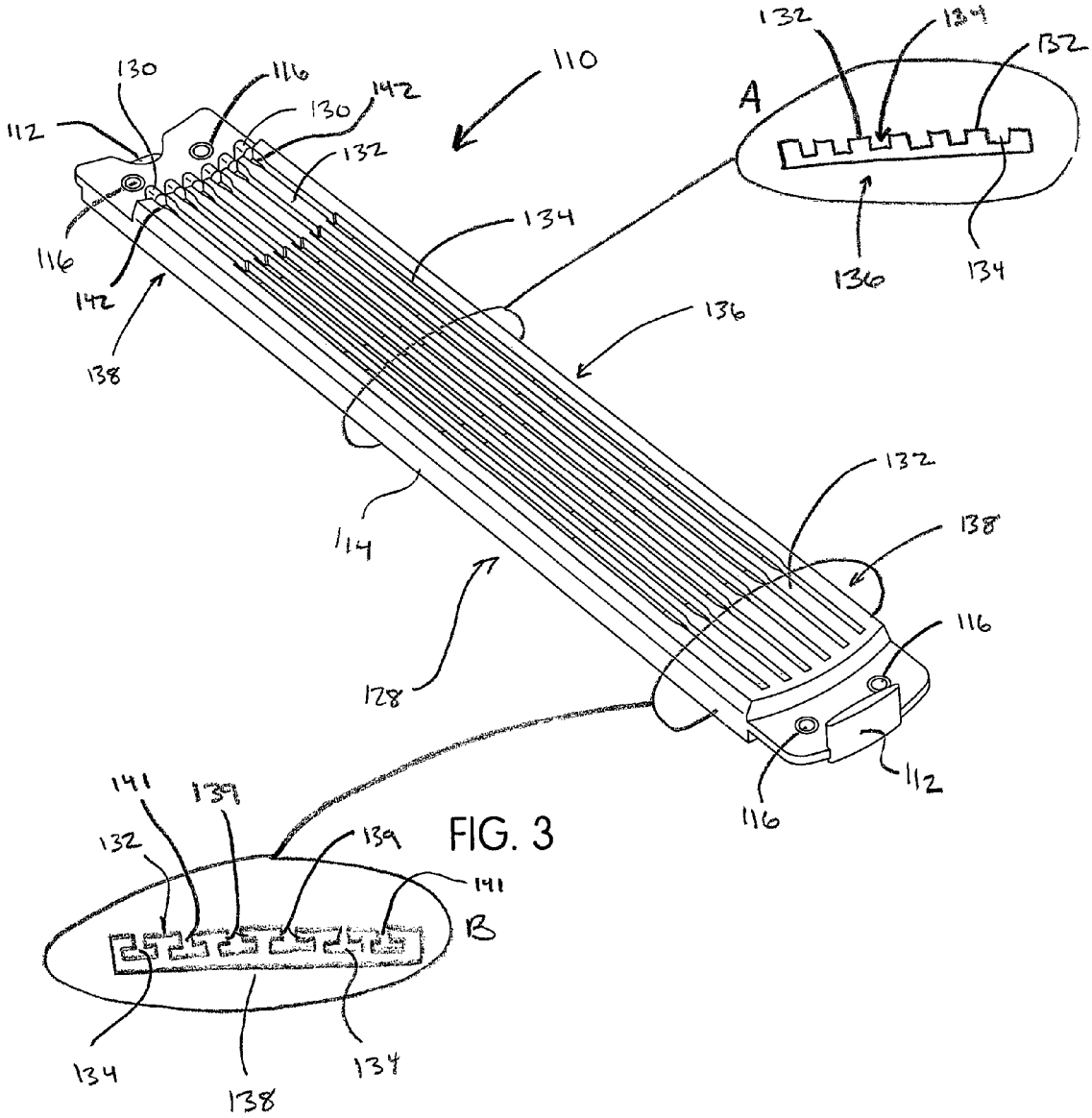
FIG. 3 illustrates a perspective view of a spine lock in a closed position according to a preferred embodiment of the invention.

FIG. 3 illustrates a perspective view of a spine lock 110 in a closed position according to a preferred embodiment of the invention. Note that in this figure, channel blocks 130 are moved into a position in which grooves 134 of channels 128 are closed off at the top end as they are at the bottom end of frame 114. By closing off the grooves 134 with channel blocks 130, document modules contained within grooves 134 of channels 128 cannot be removed. Note that one channel block 130 is provided for each groove 134.

The grooves 134 of channels 128 have a variable width along their length. At the top and bottom portions 138, channels 128 have narrow grooves 134 and wide top surfaces 132. These regions 138 are used to secure document modules as shown more clearly in FIG. 7. In the middle portion 136, channels 128 are provided with wide grooves 134 and narrower top surfaces 132 to allow for the freer movement of document modules shown in FIGS. 9-16 as they are slid down the length of channels 128. Cross-sections of regions 136 and 138 are illustrated in views A and B shown in FIG. 3. In region 136 as shown view A, grooves 134 are formed between top surfaces 132. In region 138 shown in view B, note that the width of grooves 134 is the same as in region 136 shown in view A. However, in region 138 extensions 139 are formed in top portions 132 that extend over grooves 134 to form "C" shaped channels. Note that channel openings 142 have a cross-section similar to region 136 as shown in view A.

Channel blocks 130 move laterally with respect to channels 128. Channel blocks 130 move from a locked position, as shown in FIG. 3, in which they block the openings 142 of channels 128, to an unlocked position, shown in FIGS. 5 and 6, in which openings 142 of channels 128 are unobstructed by channel blocks 130. Channel blocks 130 move between open and closed positions under the action of latch 112. Pulling latch 112 out away from frame 114 causes channel blocks 130 to slide laterally into an open position. Pushing latch 112 toward frame 114 causes channel blocks 130 to slide laterally into a closed position. Pushing and pulling latch 112 enables a user to lock and unlock modular locking binder system 100 to allow for the insertion and removal of document modules.

Figure 4:
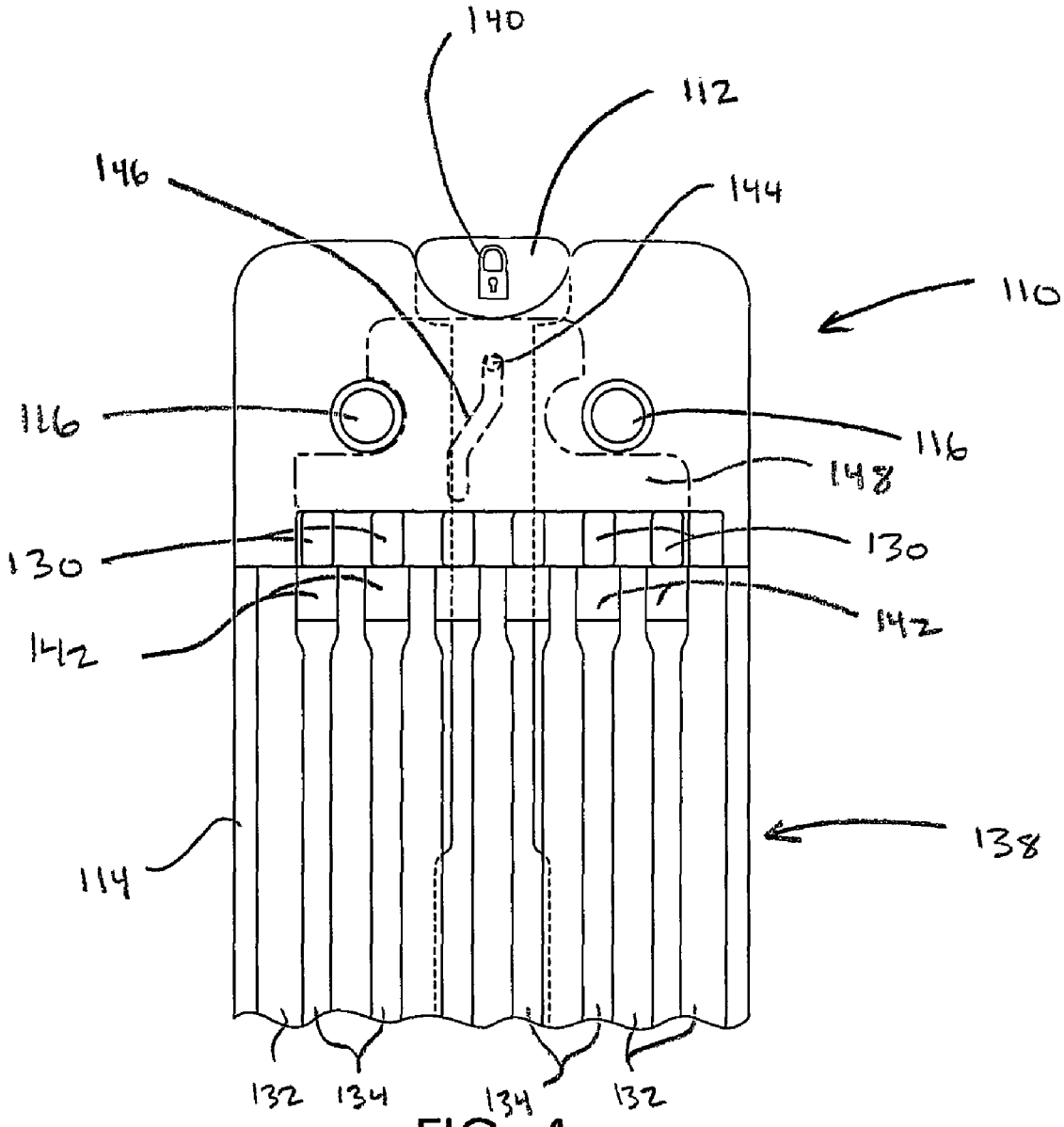
FIG. 4 illustrates a front view of a top portion of a spine lock in a closed position according to a preferred embodiment of the invention.

FIG. 4 illustrates a front view of a top portion of a spine lock 110 in a closed position according to a preferred embodiment of the invention. In the closed position, channel blocks 130 are positioned such that they block the channel openings 142 of channels 128. Thus, document modules that are contained within channels 128 are held within grooves 134 and cannot be removed. In this figure, six channel blocks 130 are provided to cover the six grooves 134. Note that the use of six channels 128 is merely exemplary, as any number of channels may be used for modular locking binder system 100. It is desirable to provide one channel block 130 for each groove 134.

Channel blocks 130 are mounted together one channel block support 148. Channel block support 148 includes a groove 146 that engages rod 144. Rod 144 is mounted to latch 112. The configuration of groove 146 converts the vertical movement of latch 112 to result in the lateral movement of channel block support 148. Latch 112 is provided with an optional lock symbol 140 at the top portion of latch 112. When latch 112 is pushed in toward frame 114, latch 112 moves vertically with respect to frame 114 and lock symbol 140 extends past frame 114 and become visible. While latch 112 moves vertically with respect to frame 114, rod 144 engages groove 146 causing channel block support 148 to move laterally into a locked position. Note that circular curves are formed in channel block support 148 to accommodate fasteners 116 that secure frame 114 to spine 102. Although the illustrated embodiment shows the latch 112 as having a manually engageable portion at one end, with a transmitting member extending the length of the spine for actuating the channel blocks 130 and their support 148 at the other end, this is not intended to be limiting. The moveably engageable portion of the latch may be at the same end of the channel blocks 130. (either bottom or top) and may connect directly to the channel blocks 130 and the support 148. Also, the latch may be moved laterally also with the intervening structure for translating vertical movement of the latch into lateral movement at the channel blocks 130 and its support 148.

Referring again to FIGS. 1 and 4, note that frame 114 is mounted at a distance away from spine 102. The distance between spine 102 and frame 114 allows for the positioning of latch 112 and channel block support 148, both of which move within the space between frame 114 and spine 102. In addition, frame 114 and spine 102 function to confine latch 112 and channel block support 148. Also note that fasteners 116 and channel block support 148 are shaped and configured to confine the motion of channel block support 148 to lateral motion with respect to channel 128.

Figure 5:
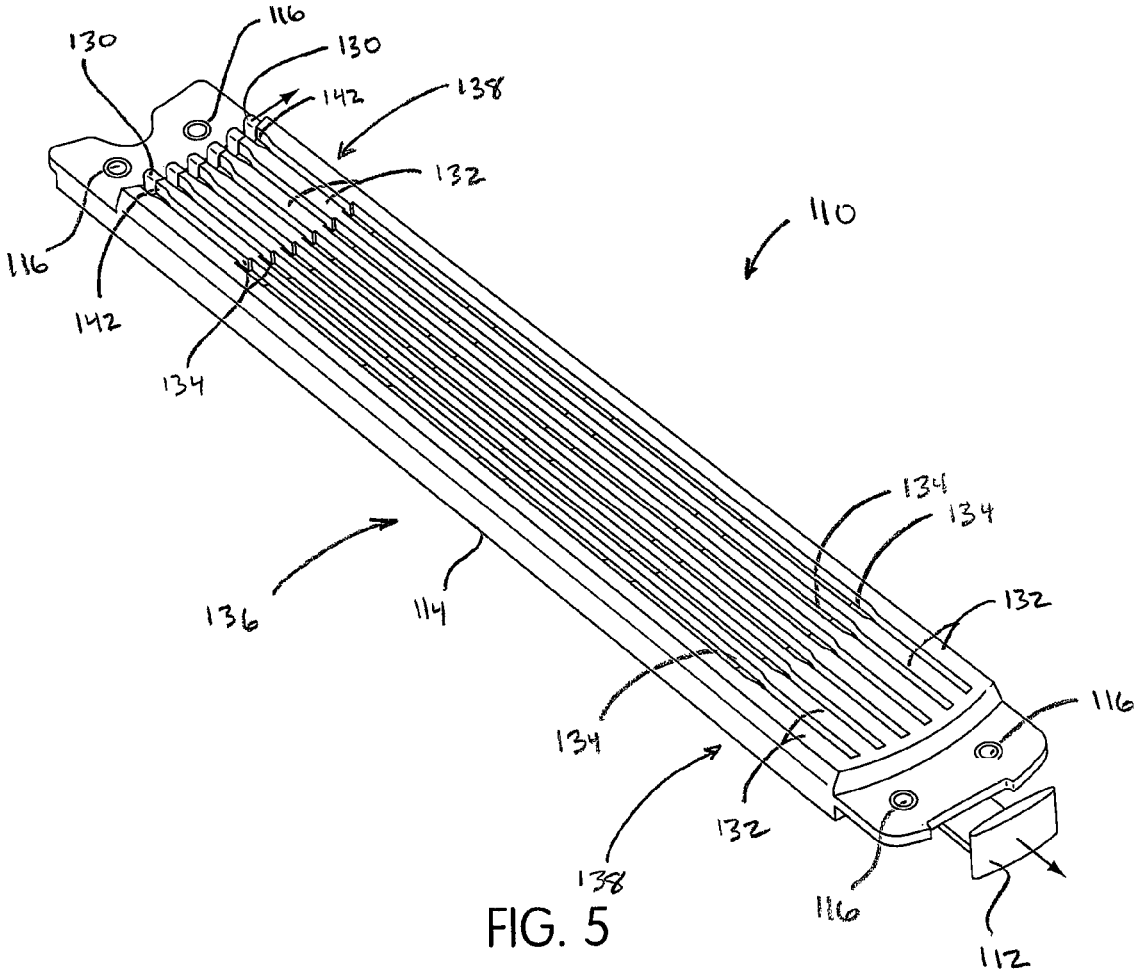
FIG. 5 illustrates a perspective view of a spine lock in an open position according to a preferred embodiment of the invention.

FIG. 5 illustrates a perspective view of a spine lock 110 in an open position according to a preferred embodiment of the invention. In this view, latch 112 has been pulled away from frame 114, thereby laterally moving channel blocks 130 into an open configuration. In the open configuration, channel openings 142 are open to the outside, thereby allowing for the insertion or removal of document modules shown in FIGS. 9-16 from channels 128. Note that latch 112 is provided with an ergonomic end surface that a user can manipulate to push and pull latch 112 with respect to frame 114, thereby unlocking and locking modular locking binder system 100.

Figure 6:
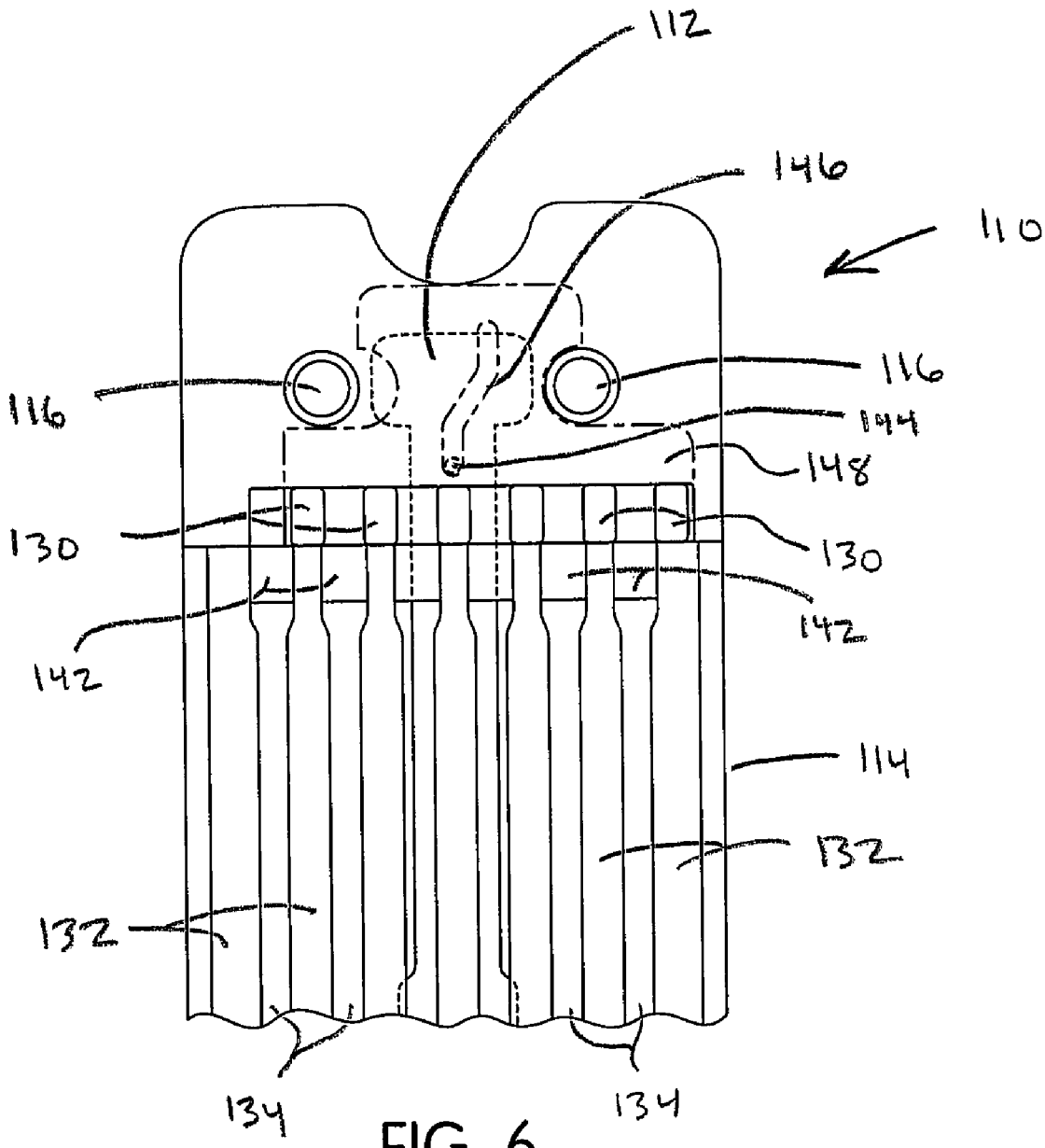
FIG. 6 illustrates a front view of a top portion of a spine lock in an open position according to a preferred embodiment of the invention.

FIG. 6 illustrates a front view of a top portion of a spine lock 110 in an open position according to a preferred embodiment of the invention. Note that in this open position, latch 112 has been moved vertically down with respect to frame 114, such that lock symbol 140 is no longer visible. By moving latch 112 vertically down with respect to frame 114, rod 144 engages groove 146 causing channel block support 148 to move laterally into an unlocked position. Note that in this unlocked position, channel blocks 130 are aligned with top surfaces 132, thereby allowing the document modules illustrated in FIGS. 9-16 to move freely in and out of channels 134 and channel openings 142. Note that fasteners 116 restrict the lateral motion of channel block support 148.

Figure 7:
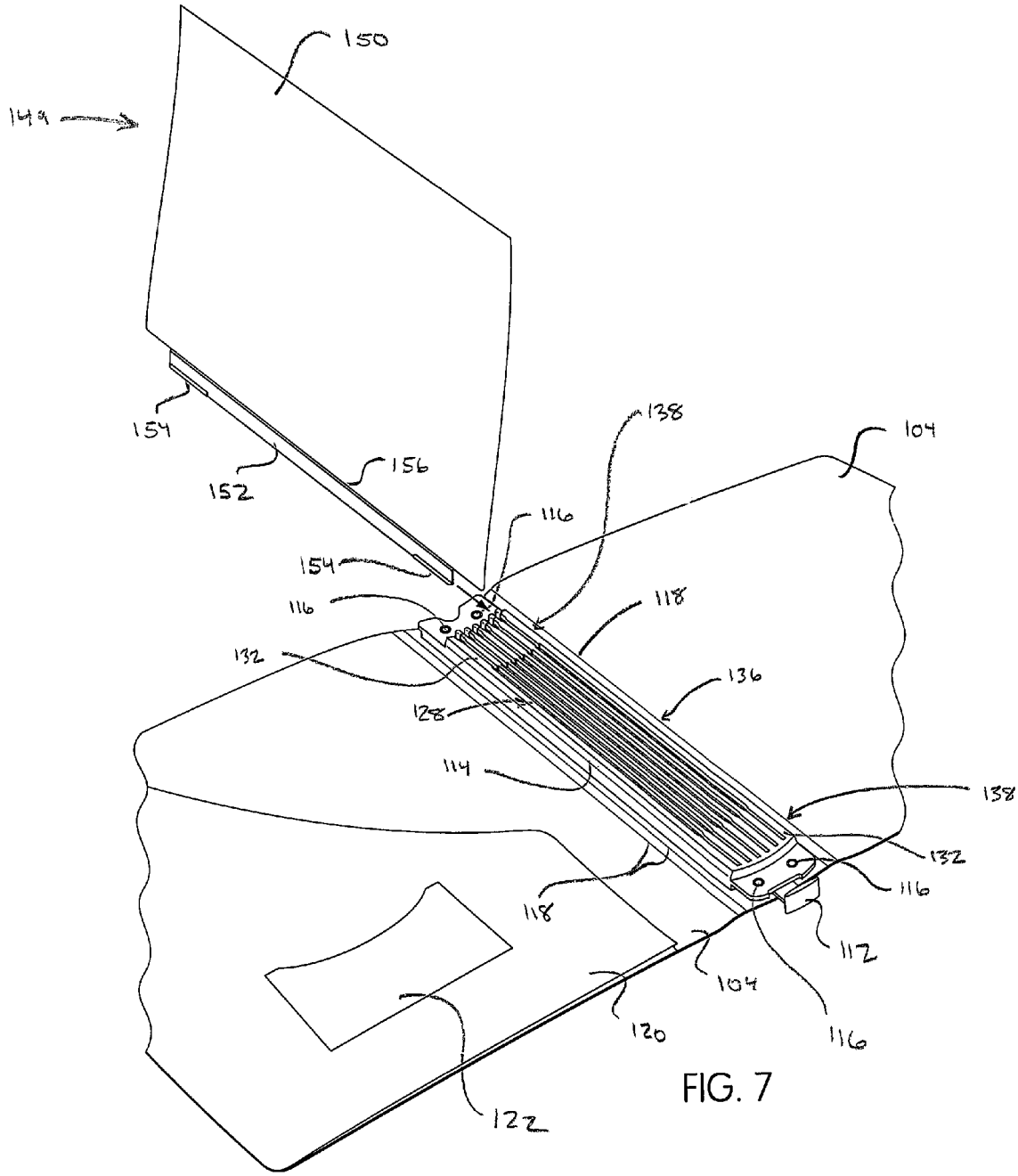
FIG. 7 illustrates a perspective view of an open modular locking binder system receiving a document module according to a preferred embodiment of the invention.

FIG. 7 illustrates a perspective view of an open modular locking binder system 100 receiving a document module 149 according to a preferred embodiment of the invention. Document module 149 includes a sheet 150, a spine 152, channel ridges 154, and flexible joint 156. Spine 152 and channel ridges 154 are configured to engage grooves 134 formed in channels 128. Spine 152 is provided with two sets of channel ridges 154 at each end of spine 152. There is a channel ridge 154 on both sides of both ends of spine 152. The channel ridges 154 form widened portions at the top and bottom ends of spine 152.

Channel ridges 154 are configured and positioned to engage the constricted ends 138 of channels 128. However, in regions 138, the top surfaces 132 are wide enough to prevent channel ridges 154 from being pulled out of channels 128. Thus, once fully slid down the length of channel 128, document module 149 cannot be pulled out from frame 114 by virtue of channel ridges 154 (i.e., in the forward direction of the figures, away from the spine), except by sliding it out of channels 128 at the top of frame 114. Note in FIG. 7 that latch 112 is pulled away from system 100 to open the channel blocks 130 to allow for the insertion of document module 149.

With reference again to FIG. 3, grooves 134 are configured to receive channel ridges 154. In region 136, channel ridges 154 may be inserted and removed from grooves 134. In region 138, channel ridges 154 may also be received by grooves 134, with spine 152 extend up through opening 141 between extensions 139 formed in top surfaces 132. While groove 134 is sufficiently wide enough to receive channel ridges 154, extensions 139 prevent channel ridges 154 from being pulled through openings 141. Thus, extensions 139 restrain channel ridges 154, and hence document module 149, within grooves 134. Frame 114, in an exemplary embodiment shown in FIG. 3, has two regions 138 with a region 136 in the middle, with channel openings 142 having a cross-section similar to region 136. However, other configurations of regions 136 and 138 in frame 114 are possible. For example, there may be a long region 138 in the middle of frame 114 with two regions 136 at each end of frame 114. In that embodiment, channels 128 may be open at both ends and have channel blocks 130 at both ends, thereby allowing for the insertion and removal of document modules 149 from either end.

Flexible joint 156 is provided to allow sheet 150 to bend with respect to spine 152. It is useful to note that the width of groove 134 in region 136 is sufficiently wide enough to allow channel ridges 154 of document module 149 to be placed into groove 134 just above the bottom region 138 adjacent to latch 112. With this configuration, it is not required to insert the leading edge of document module 149 at the very top of frame 114 and slide it down the entire length of channel 128. Instead, each channel ridge 154 may be positioned just above a respective region 138, document module 149 may then be pushed down into channel 128, and then document module 149 may be slid down so that channel ridges 154 engage portions 138 where the top surfaces 132 prevent channel ridges 154 from being pulled out from channels 128.

The width of channel opening 142 is sufficiently wide enough, along with the grooves 134 in region 136, to allow for channel ridges 154 to pass through into channel 128. Thus, while the wide portion of groove 134 in region 136 acts as a guide for the bottom set of channel ridges 154 near the bottom portion 138 of channels 128, channel openings 142 also act as a guide for the top set of channel ridges 154 near the top portion 138 of channels 128. Thus, wide portions of channels 128, 142 and 136 allow for the easy insertion of channel ridges 154, which can then be slid down along the length of channels 128 to be locked into place by the narrow portions of channels 128 in regions 138, which have wide top surfaces 132.

Figure 8:
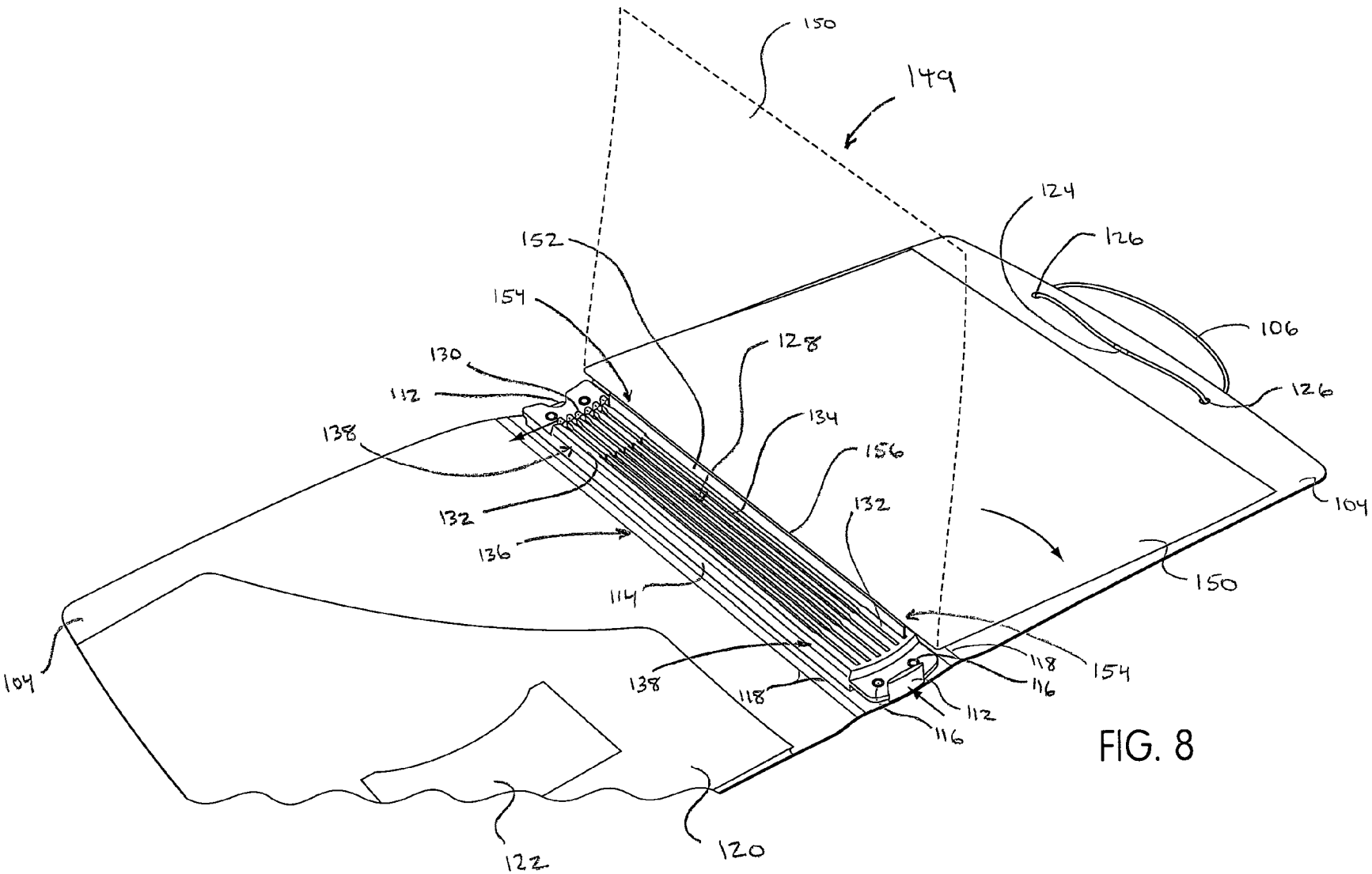
FIG. 8 illustrates a perspective view of an open modular locking binder system with a document module according to a preferred embodiment of the invention.

FIG. 8 illustrates a perspective view of an open modular locking binder system 100 with a document module 149 according to a preferred embodiment of the invention. In this figure, document module 149 has been slid down the entire length of channel 128. Consequently, the engagement of channel ridges 154 and regions 138 prevent document module 149 from being pulled out of frame 114, except by being slid out the top of channel 128. However, in this figure, channel blocks 130 have been slid over, as represented by the arrow, to block channels 128, thereby preventing document module 149 from being slid out of channel 128. Note that latch 112 has been pushed back into position against frame 114. Flexible joint 156 allows sheet 150 to bend with respect to spine 152 and lay flat against either cover flap 104.

Figure 9:
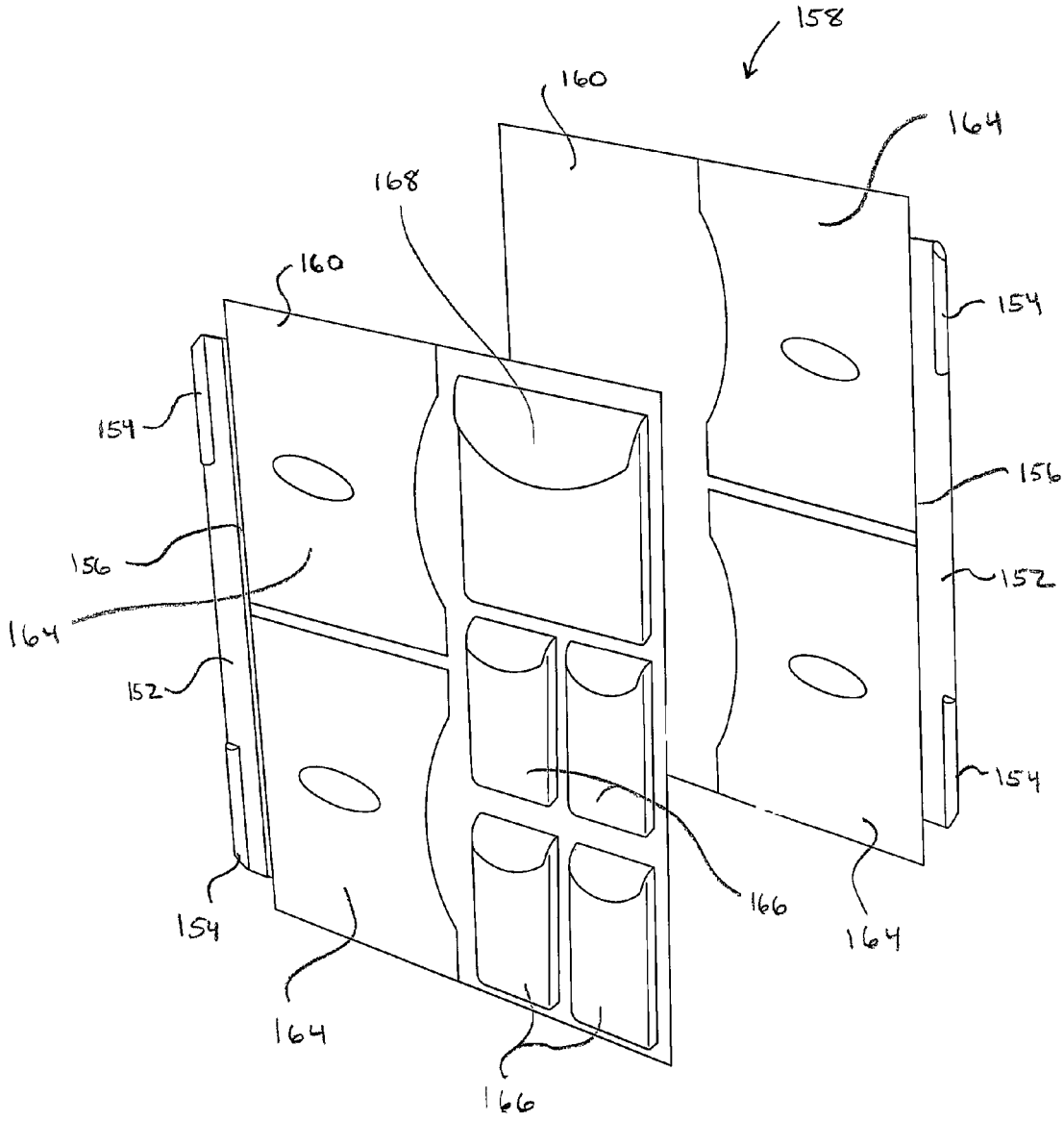
FIGS. 9-16 illustrate various document module configurations that are used in combination with the modular locking binder system according to a preferred embodiment of the invention.

FIGS. 9-16 illustrate various document module configurations that are used in combination with the modular locking binder system 100 according to a preferred embodiment of the invention. Note that each of the document modules shown in FIGS. 9-16 include a spine 152, channel ridges 154, and flexible joint 156 to enable the document modules shown in FIGS. 9-16 to made with channels 128 formed in frame 114. FIG. 9 illustrates a document module 158 that includes a flexible sheet 160 that is provided with a plurality of pockets 164, which may be used to store, for example, DVD's, CD's, floppy disks, or other materials. Module 158 also include smaller pockets 166 that can hold any sort of material or device, such as for example, erasers, memory sticks, sticky notes, cellular phones, etc. A larger pocket 168 is provided above smaller pockets 166. Note that this configuration of pockets 164, 166 and 168 is merely exemplary and sheet 160 may include any number of pockets 164, 166 and 168 in any combination.

Figure 10:
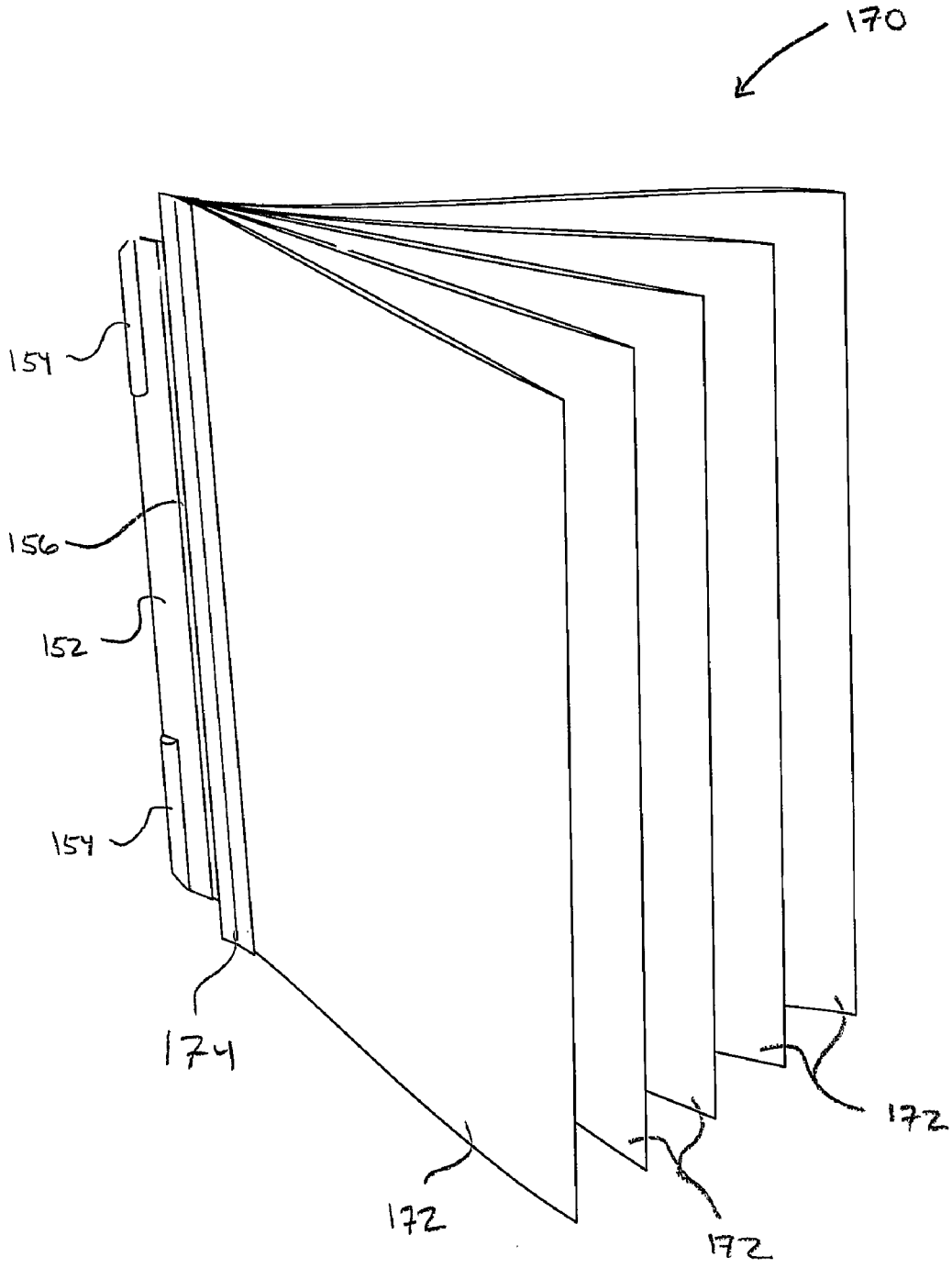

FIG. 10 illustrates document module 170. Document module 170 includes a plurality of document slips 172, which are flexible clear plastic covers which contain sheets of paper or other flexible document sheets. While module 170 is shown with five document slips 172, the use of five document slips 172 is merely exemplary and any number of document slips 172 may be used in combination with document module 170.

Figure 11:
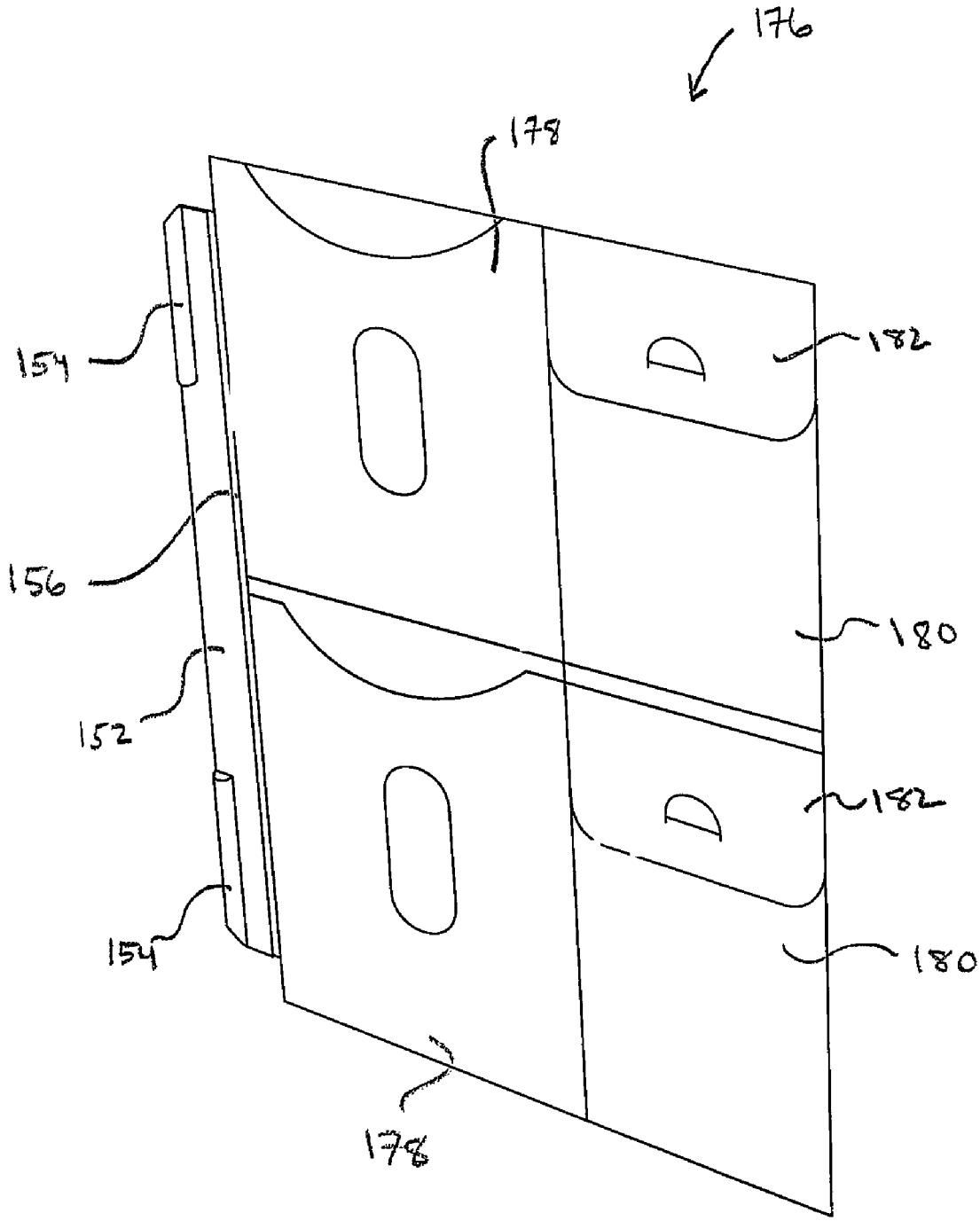

FIG. 11 illustrates document module 176. Document module 176 includes pockets 178 configured to house, for example, a CD or DVD disk. Document module 176 also includes adjacent pockets 180 that have closable cover flaps 182.

Figure 12:
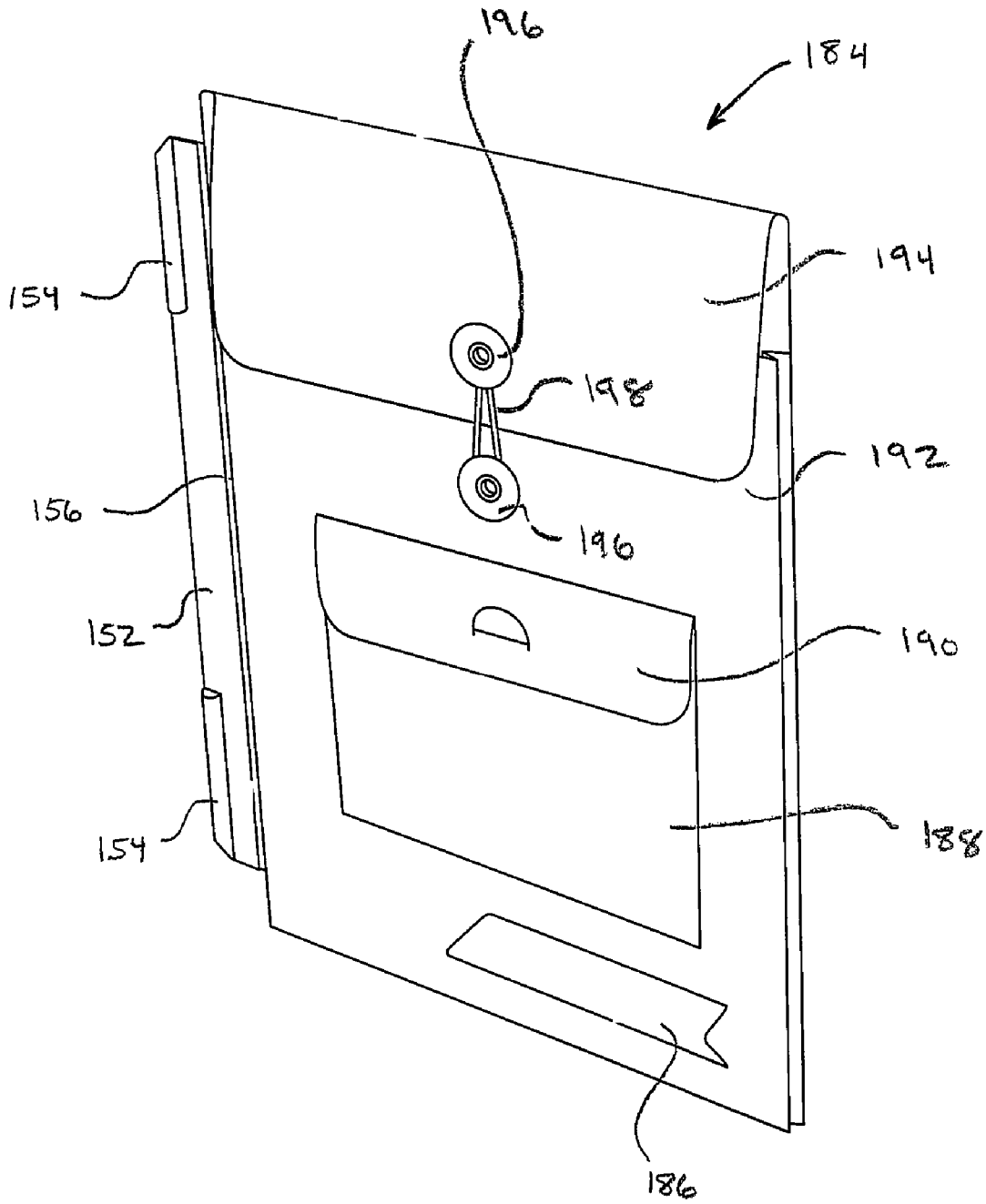

FIG. 12 illustrates document module 184. Document module 184 is provided with a small pocket 186 configured to hold an identifying label identifying the contents of document module 184. A pocket 188 is provided above pocket 186. Pocket 188 includes a closable cover flap 190. Document module 184 includes a large expandable pocket 192 and cover flap 194. Cover flap 194 and large expandable pocket 192 include mounted disks 196 that are configured to engage flexible band 198, which is used to secure the two mounted disks 196 together.

Figure 13:
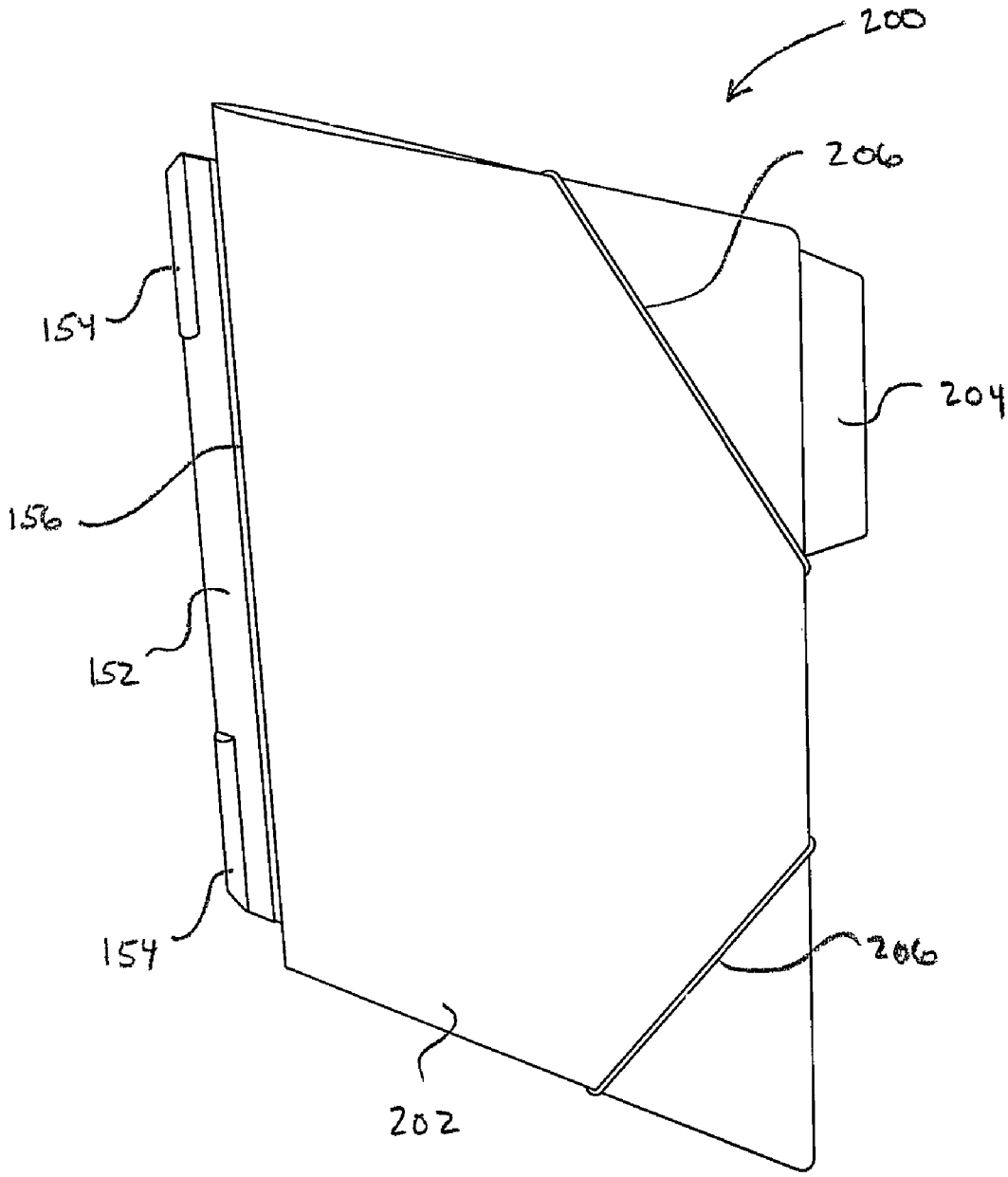

FIG. 13 illustrates document module 200. Document module 200 is essentially a conventional filing folder that includes a front cover 202 and a rear cover 204 that has a raised portion for a label. A flexible band 206 is mounted to the rear cover 204 and can be extended over the front cover 202 so as to secure that two covers 202 and 204 together.

Figure 14:
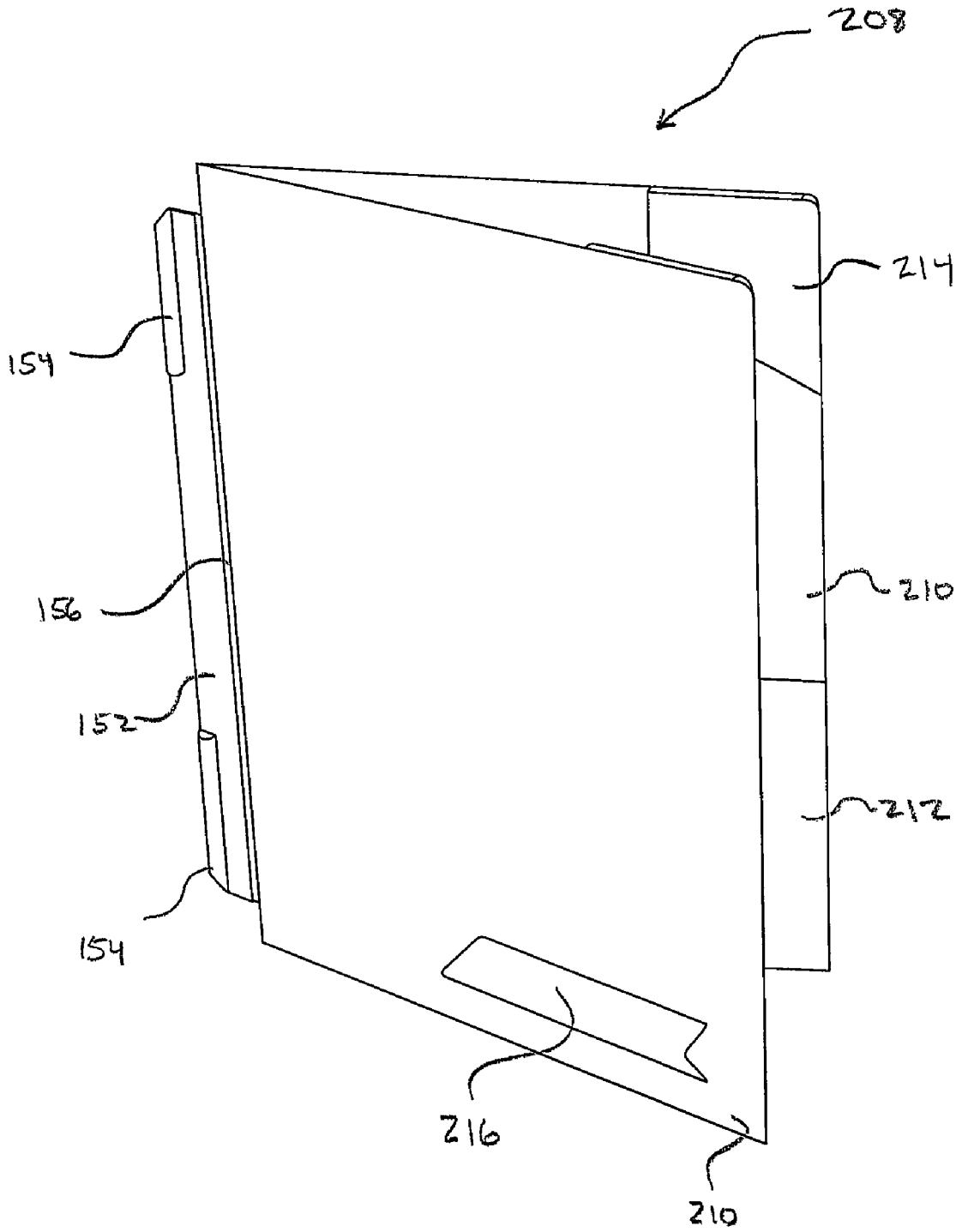

FIG. 14 illustrates document module 208. Document module 208 includes a pair of covers 210. The interior of covers 210 include bottom document flaps 112 and top document flaps 214 that are used to retain documents within document module 208. A horizontal pocket 216 is provided on the front of one of the covers to retain a label so that a user can identify the contents of document module 208.

Figure 15:
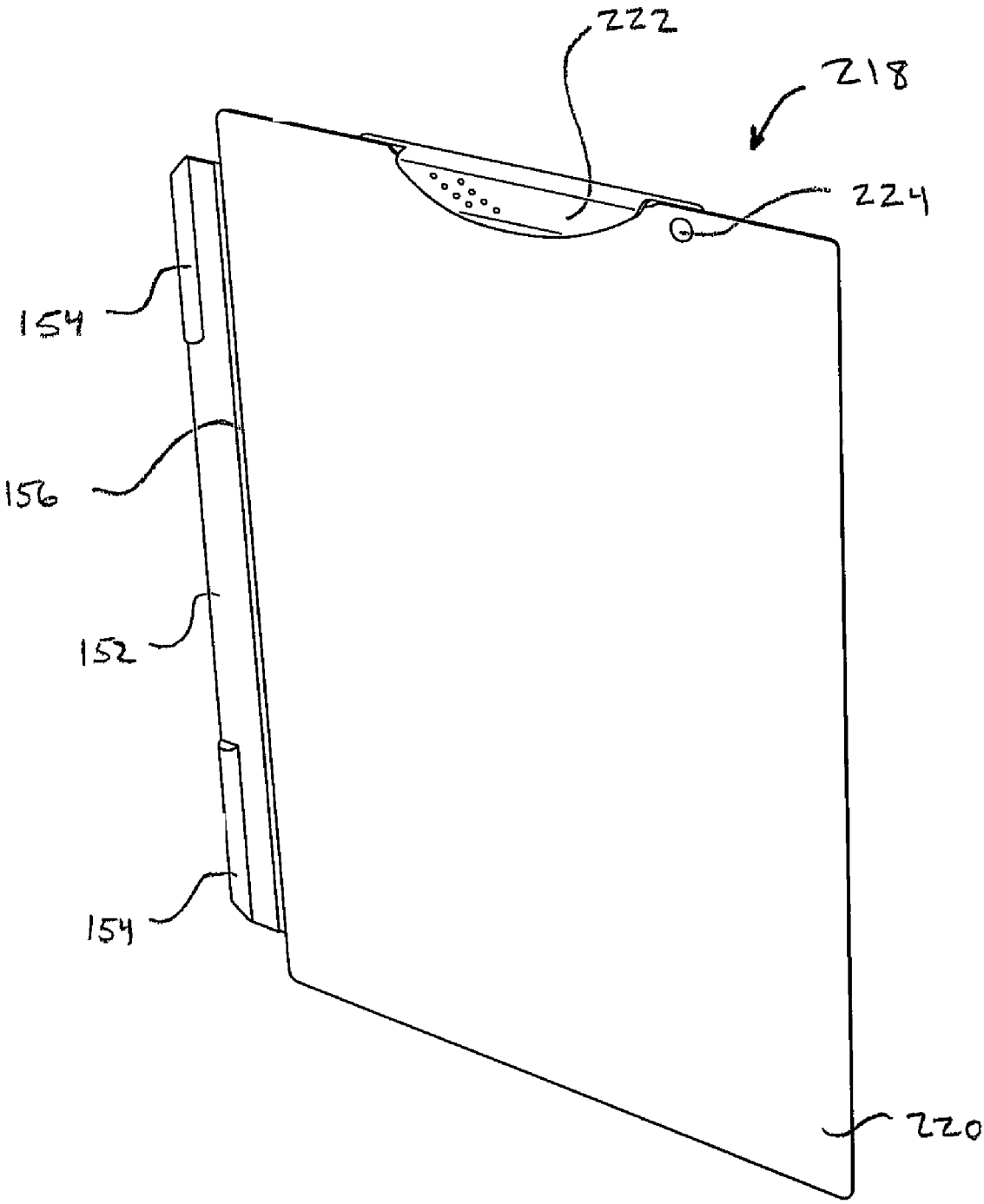

FIG. 15 illustrates a document module 218, that generally has the configuration of a conventional clip-board. Document module 218 includes a flat, generally rigid panel 220, upon which a clip 222 is pivotally fastened with rivet 224. Clip 222 is used to hold documents against panel 220.

Figure 16:
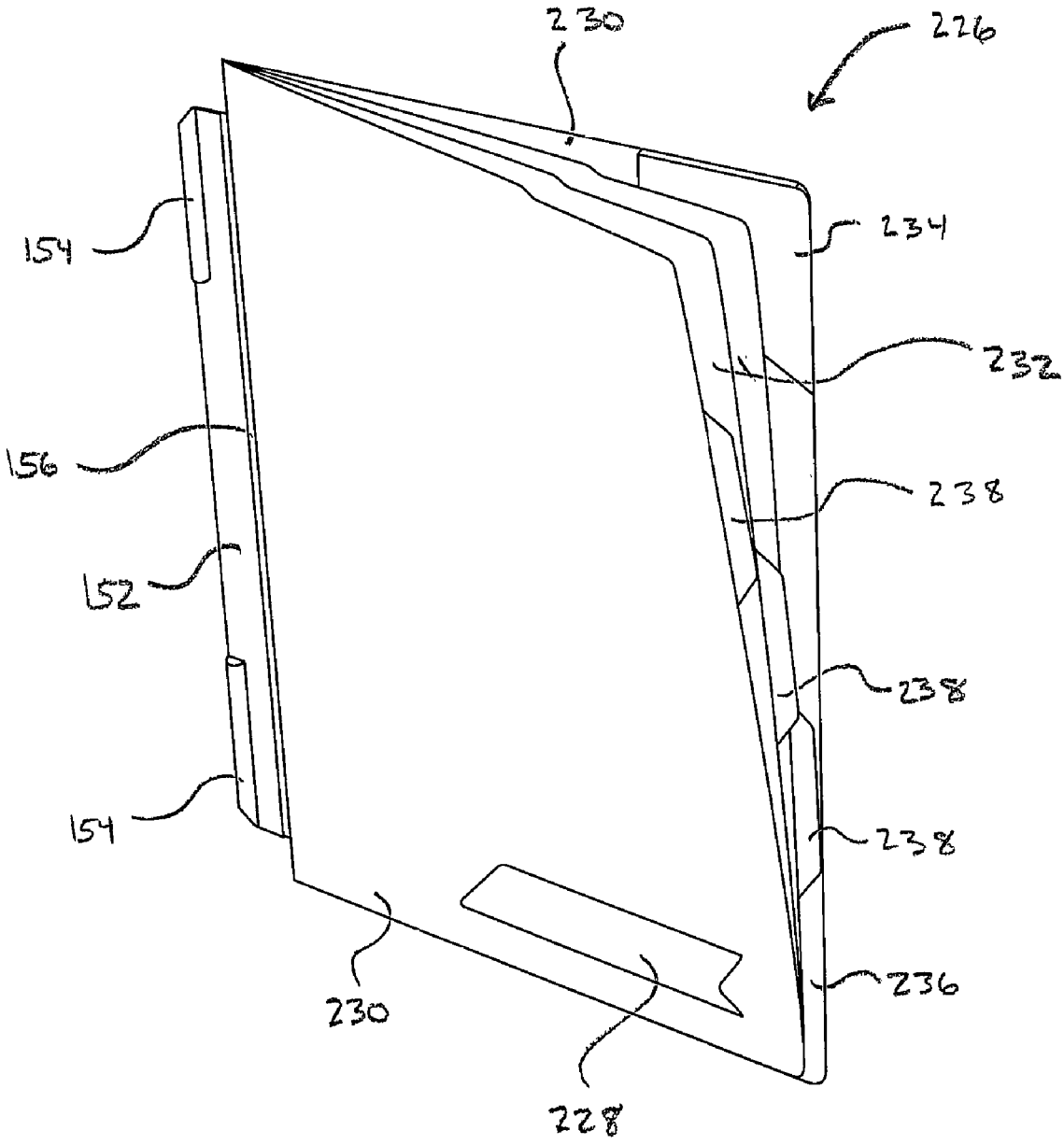

FIG. 16 illustrates a document module 226 that includes a front pocket 228 configured to hold a label for identifying the contents of document module 226. Front pocket 228 is located on one of the two covers 230 forming document module 226. Covers 230 include top pockets 234 and bottom pockets 236 that are provided to secure documents within document module 226. Between covers 230, a plurality of document dividers 232 are provided to separate groups of documents from each other Tabs 238 are provided at the end of each document divider to allow for the labeling of each grouping of documents.

Figure 17:
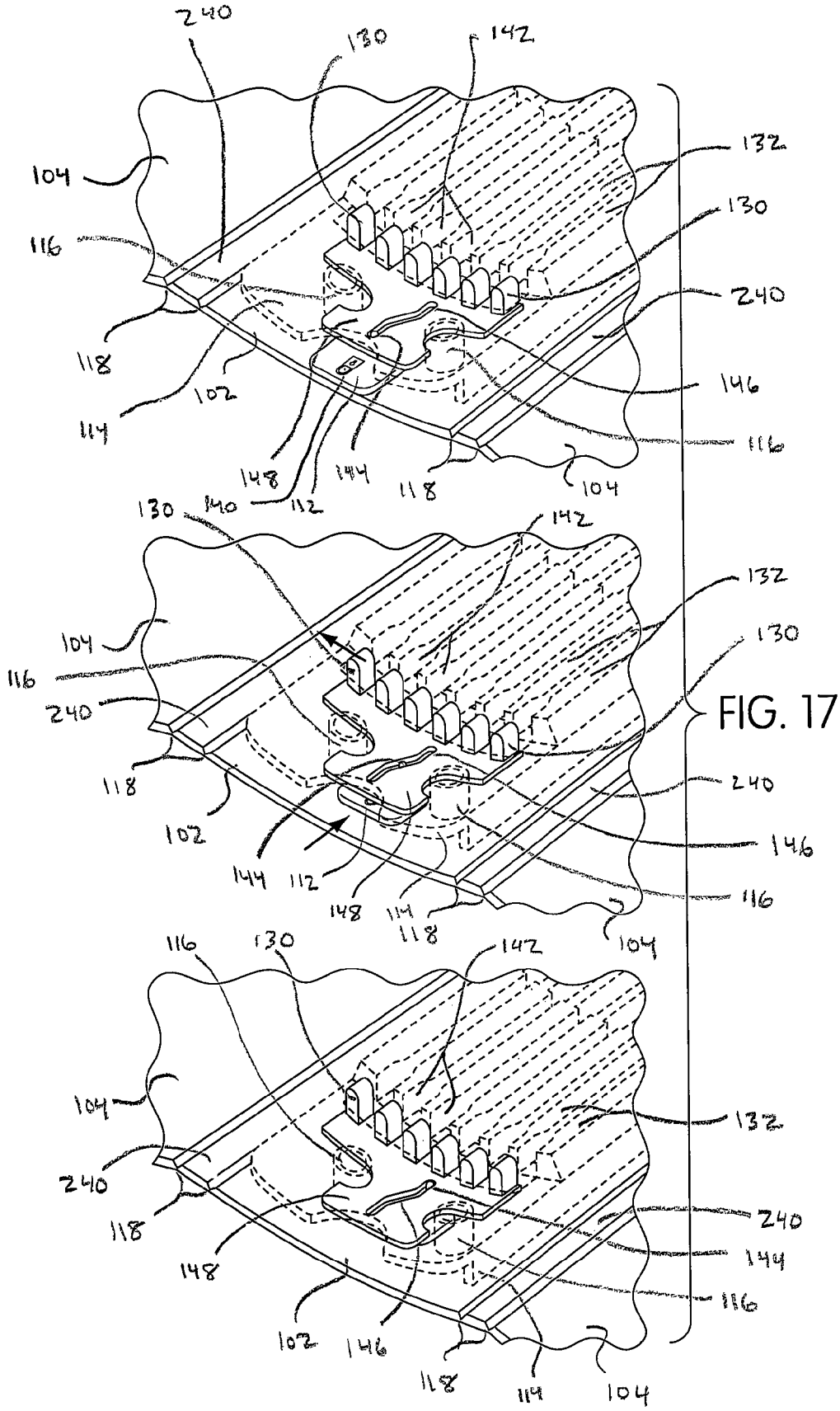
FIG. 17 illustrates three perspective views of a top portion of a spine lock depicting the movement of a row of channel blocks in conjunction with a latch that lock document modules within the modular locking binder system.

FIG. 17 illustrates three perspective views of a top portion of a spine lock depicting the movement of a row of channel blocks 130 in conjunction with a latch 112 that lock document modules, shown in FIGS. 7-16, within the modular locking binder system 100. Channel blocks 130 are all mounted to channel block support 148. Channel block support 148 is movably positioned between fasteners 116 underneath frame 114 against spine 102. Channel block support 148 is configured to move laterally with respect to channel openings 142. As all of the channel blocks 130 are connected to the same channel block support 148, all of the channel blocks 130 move together in unison. Channel block support 148 moves laterally between open and closed positions based upon the movement of latch 112. Channel block support 148 includes a groove 146 that is engaged with rod 144 mounted to latch 112. The movement of latch 112 causes rod 144 to move up or down vertically. The up and down vertical movement of rod 144 is translated into lateral movement of channel block support 148 by the configuration of groove 146. Note that in this closed position, channel blocks 130 close off channel openings 142. Also note that in this closed position lock symbol 140 is clearly visible at the top of frame 114.

Note in FIG. 17, spine 102 and cover 104 include grooves 118 to allow cover 104 to bend with respect to spine 102. A pair of grooves form a strip 240 that cooperates with cover 104 and spine 102 to allow spine 102 and cover 104 to bend with respect to each other, thereby allowing modular locking binder system 100 to open and close.

The top view in FIG. 17 illustrates latch 112 and channel blocks 130 in a locked position, wherein lock symbol 140 is shown designating that latch 112 is locked. Note that in this locked position, rod 144 is located at the top portion of groove 146. The middle view of FIG. 17 shows latch 112 and channel blocks 130 halfway between a locked and an unlocked position. At this halfway point, rod 144 is in the middle of groove 146. Channel blocks 130 are moved into this halfway position by pulling latch 112 away from frame 114 to a position where rod 146 has moved down the length of groove 146 causing channel block support 148 to move laterally.

The bottom view in FIG. 17 illustrates latch 112 and channel blocks 120 in an open position. Note that in this open position, latch 112 has been pulled fully away from frame 114, thereby making lock symbol 140 no longer visible at the top portion of frame 114. In this unlocked configuration, channel blocks 130 are pulled fully to one side thereby opening channel openings 142. In the open configuration, document modules shown in FIGS. 7-16 may be inserted into channel openings 142. Once a document module is fully inserted into a channel 128 in frame 114, latch 112 is pushed into a closed configuration to close channel openings 142 with channel blocks 130, thereby holding document modules within frame 114. Note that in this open configuration, rod 144 is at the bottom of groove 144. Note that latch 112 is held in the locked position shown in the top view by a snap-fit that is formed when latch 112 is pressed against frame 114.

It should be noted that directional terms, such as top and bottom, have been used merely for convenience in reference to the drawings. Such terms are not intended to be limiting, and are merely used as a matter of convenience for making reference to the drawings. As such, any structure referred to in such a manner, may be located different, and the use of a directional term is not to be taken as limiting.

While the invention has been shown and described with reference to a particular embodiment thereof, it will be understood to those skilled in the art, that various changes in form and details may be made therein without departing from the spirit and scope of the invention.

What is claimed is:

1. A modular locking binder system, comprising:

a binder, comprising:

a binder spine;

a pair of cover-flaps attached to said binder spine, wherein at least one of the cover-flaps is attached to the binder spine for pivotal movement to allow the binder to be opened and closed;

a document module retainer provided on the binder spine, the document module retainer having a channel extending in a longitudinal direction of the binder spine, said channel having an open longitudinal end and a longitudinally extending opening that has a constricted region along at least a portion of said channel; and a channel block located at the open longitudinal end of said channel, said channel block being configured to move from an open position wherein the open longitudinal end of said channel is unobstructed by said channel block, and a closed position wherein the open longitudinal end of said channel is obstructed by said channel block; and a document module removably attached within said channel, said document module comprising a module spine having a widened portion configured to be received longitudinally in the constricted region of said channel, wherein when the widened portion is longitudinally received in the constricted region, the constricted region prevents lateral withdrawal of the widened portion of the document module through the constricted region of the longitudinally extending opening, and wherein when the channel block is in the closed position, the channel block obstructs said channel and prevents longitudinal removal of widened portion of said document module from its receipt in the constricted region, and wherein when the channel block is in the open position, the channel block does not obstruct the longitudinal removal of said widened portion of said document module from its receipt in the constricted region, which pennits the removal of said document module from said binder.

2. The system of claim 1, wherein the longitudinally extending opening of said channel further comprises a first portion having a width sufficient to allow for the lateral removal there through of the widened portion of said document module from said channel.

3. The system of claim 2, wherein:

the constricted region of the longitudinally extending opening comprises a first constricted region;

the longitudinally extending opening has a second constricted region;

the first portion of the longitudinally extending opening is longitudinally disposed between the first and second constricted regions;

the second constricted region is longitudinally disposed between the open longitudinal end and the first portion of the longitudinally extending opening;

the widened portion of the module spine comprises a first widened portion;

the module spine comprises a second widened portion configured to be received longitudinally in the second constricted region of said channel when the first widened portion is received longitudinally in the first constricted region of said channel; and when the second widened portion is longitudinally received in the second constricted region, the second constricted region prevents lateral withdrawal of the second widened portion through the second constricted region.

4. The system of claim 1, further comprising a latch document module retainer, wherein said latch actuates said channel block between open and closed positions.

5. The system of claim 4, wherein said latch moves parallel to a longitudinal axis of said channel.

6. The system of claim 5, wherein said channel block moves perpendicular to the longitudinal axis of said channel.

7. The system of claim 6, wherein said latch is operatively connected to said channel block such that a vertical movement of said latch is translated into a horizontal movement of said channel block.

8. The system of claim 7, wherein said latch is positioned between said channel and said binder spine.

9. The system of claim 8, wherein said document module retainer comprises a plurality of said channels, thereby allowing said binder to removably be attached to a plurality of said document modules.

10. A modular document system, comprising:

a plurality of document modules, each document module having a spine with a widened portion;

a binder configured to removably hold said plurality of document modules, said binder comprising:

a binder spine;

a pair of cover flaps attached to said binder spine, wherein at least one of the cover-flaps is attached to the binder spine for pivotal movement to allow the binder to be opened and closed;

a frame attached to said binder spine, said frame comprising a plurality of channels having a longitudinally extending opening with a narrow portion configured to longitudinally receive the widened portion of a respective one of the plurality of document modules and prevent lateral withdrawal thereof through the longitudinally extending opening; and a locking mechanism configured to restrain each document module within its respective one of the plurality of channels, whereby unlocking said locking mechanism allows for the insertion or removal of a document module from a channel, wherein when two of the plurality of document modules are received in their respective ones of the plurality of channels, each of the two of the plurality of document modules can be withdrawn from its respective one of the plurality of channels without withdrawing the other of the two of the plurality of document modules from its respective one of the plurality of channels.

11. The modular document system of claim 10, wherein each of said plurality of channels further comprises a wide portion allowing for the lateral insertion and removal of the widened portion of one of said document modules.

12. The modular document system of claim 11, wherein each of said plurality of channels comprises an open end and a closed end.

13. The modular document system of claim 12, wherein said locking mechanism comprises a row of channel blocks, wherein said channel blocks move perpendicular to a longitudinal axis of said plurality of channels between an open position that does not obstruct the open end of each of said channels and a closed position where each channel block obstructs each open end of each channel.

14. The system of claim 12, wherein:

the narrow portion of the longitudinally extending opening of each of the plurality of channels comprises a first narrow portion;

the longitudinally extending opening of each of the plurality of channels has a second narrow portion;

the wide portion of the longitudinally extending opening of each of the plurality of channels is longitudinally disposed between the first and second narrow portions;

the second narrow portion is longitudinally disposed between the open end and the wide portion;

the widened portion of the module spine of each of the plurality of document modules comprises a first widened portion;

the module spine of each of the plurality of document modules comprises a second widened portion configured to be received longitudinally in a respective narrow portion of a respective one of the plurality of channels when the first widened portion is received longitudinally in the first narrow portion of said respective one of the plurality of channels; and when the second widened portion is longitudinally received in the second narrow portion, the second narrow portion prevents lateral withdrawal of the second widened portion through the second narrow portion.

15. The modular document system of claim 13, further comprising a latch operatively coupled to said row of channel blocks, wherein said latch moves said channel blocks between open and closed positions.

16. The modular document system of claim 15, wherein said latch moves parallel to a lengthwise axis of said channels, and said channel blocks move perpendicular to the lengthwise axis of said channels.

17. The modular document system of claim 16, wherein a locking symbol is projected from a top portion of said channels signifying that the locking mechanism is locked.

18. A binder, comprising:

a binder spine;

a pair of covers attached to said binder spine, wherein at least one of the covers is attached to the binder spine for pivotal movement to allow the binder to be opened and closed;

a frame attached to said binder spine; said frame comprising:

a channel having an open longitudinal end and a longitudinally extending opening that has a constricted portion; and a latch configured to block and unblock the open longitudinal end of said channel; and a document module having a module spine, said document module having a protrusion extending from said module spine, wherein said protrusion is configured to be received longitudinally by the constricted portion of said channel, wherein when the protrusion is longitudinally received by the constricted portion, the constricted portion prevents lateral withdrawal of the protrusion through the constricted portion of the longitudinally extending opening, wherein opening said latch to unblock the open longitudinal end of said channel allows for said module spine to be inserted into said channel and have said protrusion be restrained by the constricted portion, wherein blocking said channel with said latch restrains said document module within said channel together with said constricted portion.

19. The binder of claim 18, said channel further comprising a second portion having a width that permits the lateral insertion and removal of said protrusion.

20. The binder of claim 19, said latch comprising a channel block that laterally moves perpendicular to a longitudinal axis of said channel.

21. The binder of claim 20, said latch further comprising a member configured to move said channel block between blocking and unblocking said channel, said member configured to move parallel to the longitudinal axis of said channel.

22. The binder of claim 21, wherein said latch is positioned between said frame and said binder spine.

23. The binder of claim 22, wherein said latch forms a "snap-fit" with said frame when it is in a locked position.

24. The binder of claim 23, wherein said frame is raised above said binder spine by fasteners that connect said frame to said spine, thereby providing space for said latch.

25. The binder of claim 24, wherein said fasteners restrict the movement of said latch.

26. The binder of claim 18, wherein:

the constricted portion of the longitudinally extending opening comprises a first constricted portion;

the longitudinally extending opening has a second constricted portion;

the protrusion comprises a first protrusion;

said channel further comprises a wide portion having a width that permits the lateral insertion and removal of said first protrusion;

the wide portion is longitudinally disposed between the first and second constricted portions;

the second constricted portion is longitudinally disposed between the open longitudinal end and the wide portion;

the module spine comprises a second protrusion extending from said module spine, the second protrusion being configured to be received longitudinally in the second constricted portion of said channel when the first protrusion is received longitudinally in the first constricted portion of said channel; and when the second protrusion is longitudinally received in the second constricted portion, the second constricted portion prevents lateral withdrawal of the protrusion through the second constricted portion.

* * * * *